United States Patent [19]

Bermudez Munoz

[11] 4,072,235

[45] Feb. 7, 1978

[54] MODULAR DISPLAY DEVICE

[75] Inventor: Francisco Bermudez Munoz, Cartagena, Spain

[73] Assignee: Diego Zamora S.A., San Antonio Abad (Cartagena), Spain

[21] Appl. No.: 660,404

[22] Filed: Feb. 23, 1976

[51] Int. Cl.[2] ..... A47G 29/00

[52] U.S. Cl. ..... 211/71; 211/194

[58] Field of Search ..... 211/194, 14, 49, 50, 211/53, 56, 58, 70, 71, 72, 78, 126, 129, 131, 133, 163; 248/146, 158, 159, 415; 108/59, 91–94

[56] References Cited

U.S. PATENT DOCUMENTS

| | | | |
|---|---|---|---|
| D. 191,811 | 11/1961 | Levinson | 211/126 X |
| 2,953,257 | 9/1960 | McNeill | 211/131 |
| 3,198,338 | 8/1965 | McCormick | 211/14 |
| 3,339,752 | 9/1967 | Trogan | 248/159 X |
| 3,543,943 | 12/1970 | Joy et al. | 211/131 |

*Primary Examiner*—Roy D. Frazier
*Assistant Examiner*—Terrell P. Lewis
*Attorney, Agent, or Firm*—Wenderoth, Lind & Ponack

[57] ABSTRACT

A modular display device includes a base member, the upper part of which has a projection which extends into a center hole in the lowermost of a plurality of identical vertically stacked modular members, each of which has a plurality of radially extending arms, each of which includes parallel opposite side walls, each of which is joined at an upper part thereof, to the adjacent wall of the adjoining arm, with which it forms a dihedral angle, by means of a triangular shaped element, the free side of which has a notch. The notches receive tongue elements of the next upper modular member, thereby attaching one modular member to another. The assembly is finished off at the top with an upper member the lower part of which is provided with tongues to be coupled to the upper part of the uppermost modular member.

5 Claims, 9 Drawing Figures

MODULAR DISPLAY DEVICE

BACKGROUND AND BRIEF DESCRIPTION OF THE INVENTION

The present invention relates to a modular display device, especially appropriate for the display and sale of articles arranged in parallelepiped shaped containers.

This type of display device has two fundamental advantages:

a. The product is visible.

b. The product is within the reach of the consumer.

The modular display device of the present invention adds the additional advantages in that it is designed so as to be placed on a counter without preparing the counter in any way, that the display device can be constructed to any desired height, and that the display device can be assembled and dismantled quickly without the need of tools.

The display device is formed of three types of members, the first of which acts as the base of the assembly, and the last of which is a top member for supporting a list of the products. Between the base and the top member are a plurality of identical intermediate of modular members which are fitted together and to the base and top member. As many intermediate or modular members as necessary are provided to provide the desired height for the display device. The modular members act as the supports for the product to be displayed. Each of the modular members has a series of radially extending rectangular arms uniformly distributed therearound. Each arm has two parallel side walls. Adjacent side walls of adjacent arms are joined at the tops thereof by a triangular shaped element, the free radially outer edge of which has therein a notch. The notches are positioned such that they receive tongue elements depending downwardly from the centers of each arm of the next upper positioned modular element when the upper modular element is circumferentially angularly displaced with respect to the next lower modular element.

BRIEF DESCRIPTION OF THE DRAWINGS

Other objects and features of the present invention will be apparent from the following detailed description thereof, with reference to the attached drawings, wherein.

DETAILED DESCRIPTION OF THE INVENTION

Figure 1:
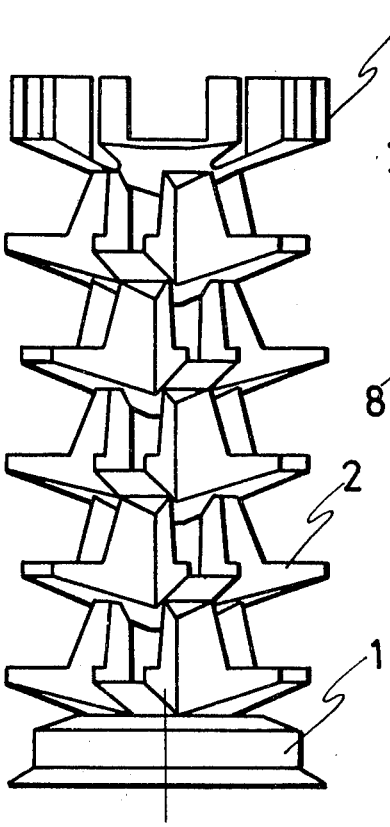
FIG. 1 is an elevational view of an assembled display device according to the invention.
Figure 2:
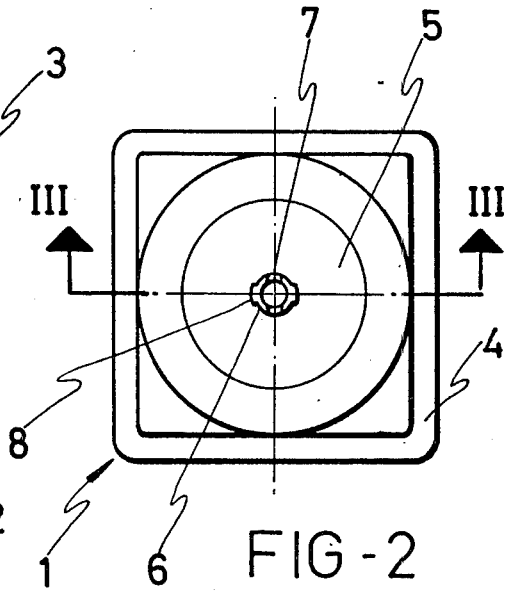
FIG. 2 is a plan view of the base member of the display device of FIG. 1.
Figure 3:
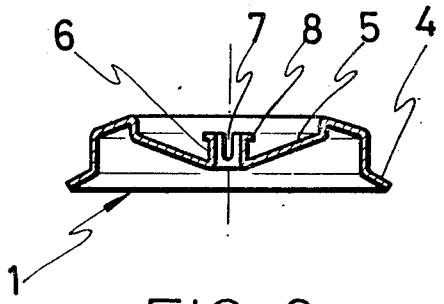
FIG. 3 is a section taken along line III—III of FIG. 2.
Figure 4:
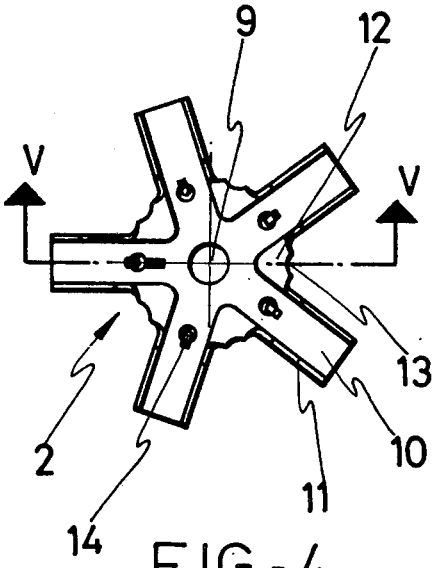
FIG. 4 is a plan view of one of the modular members of the display device illustrated in FIG. 1.
Figure 6:
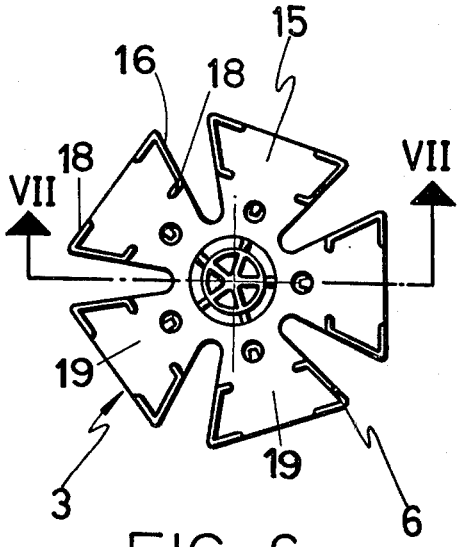
FIG. 6 is a plan view of the upper member of the display device illustrated in FIG. 1.
Figure 5:
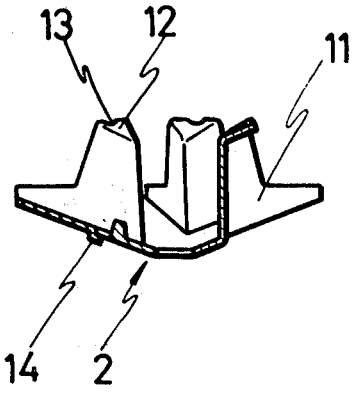
FIG. 5 is a section taken along line V—V of FIG. 4.
Figure 7:
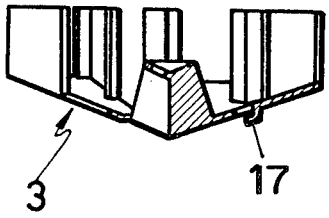
FIG. 7 is a section taken along line VII—VII of FIG. 6.
Figure 8:
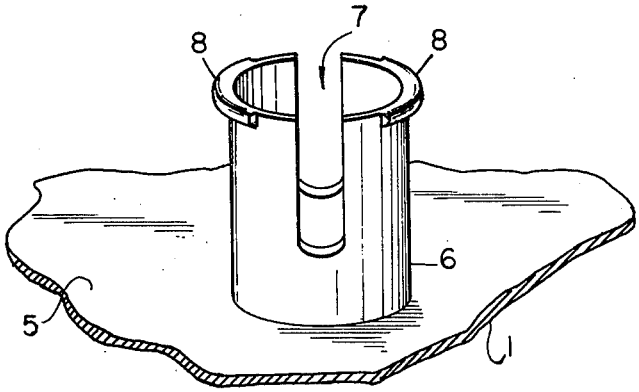
FIG. 8 is an enlarged perspective view of a portion of the base member.
Figure 9:
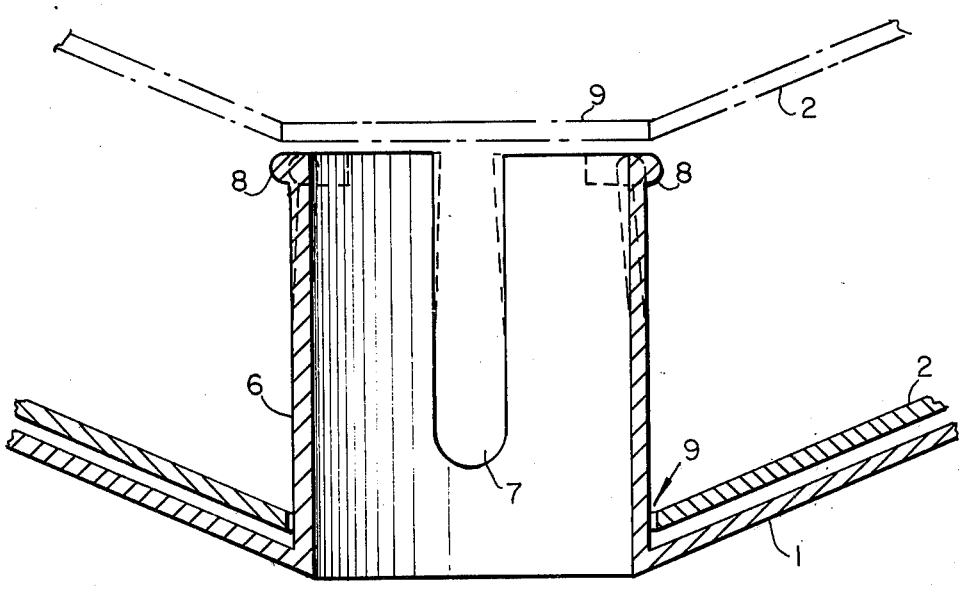
FIG. 9 is an enlarged section of a portion of the base member and illustrating the manner of assembly thereto of the modular member of FIG. 4.

Referring to FIG. 1, it will be seen that the display device includes a base member 1, a plurality of intermediate modular members 2 and an upper member 3.

As shown in FIGS. 2, 3, 8 and 9, the base member 1 has a lower supporting part 4 having joined thereto a central portion having an inwardly recessed concave portion 5. Extending upwardly from the center of portion 5 is a cylindrical projection 6 having therein axial slots 7 defining separate projection portions each having at the outer end thereof an outwardly extending flange 8. As shown by the dashed lines in FIG. 9, slots 7 allow the projection portions to deflect inwardly so that a central hole 9 of a modular member 2 may receive projection 6. The diameter of hole 9 is approximately equal to that of projection 6 when not deflected inwardly. Flanges 8 prevent modular member 2 from becoming unintentionally removed from projection 6.

Each modular member includes a plurality, e.g. five, of radial arms 10 extending radially outwardly from hole 9 and uniformly distributed therearound. Each arm is formed by a bottom wall and two side walls 11 which form product receiving areas. Each side wall 11 forms a dihedral angle with the adjacent side wall 11 of the adjoining arm. The upper portions of the side walls which form each dihedral angle are joined by a triangular shaped element 12, the apex of which is at the apex of the dihedral angle, and the free side of which opposite the apex has therein a notch 13. Each of the notches 13 are positioned such that they receive tongue elements 14 depending downwardly from the arms 10 of the next upper positioned modular member 2 when such upper modular member is angularly displaced with respect to the next lower modular member by an angle such that the arms of the upper modular member are aligned midway between the arms of the next lower modular member. The receipt of tongue elements 14 in notches 13 fixed the modular members together, thereby allowing a plurality of modular members to be vertically stacked on base member 1.

The upper member 3 is similar in construction to the modular members 2 in that upper member 3 has an equal number of radially outwardly extending arms 14, each of which however is generally trapezoidally shaped. Each arm 15 is formed by a bottom wall and opposite side walls 16 which are not joined but which have portions 18 which are bent inwardly to form a product list receiving area 19 on each arm. Upper member 3 has depending downwardly from each arm 15 thereof a tongue element 17 positioned to be received in notches 13 of the uppermost modular element 2, when upper member 3 is angularly displaced with respect to the uppermost modular element.

I claim:

1. A modular display device comprising:

a base member having extending upwardly therefrom a cylindrical projection having therein axial slots defining inwardly deformable projection portions each having at the upper end thereof an outwardly extending flange;

a plurality of modular members stacked vertically above said base member, the lowermost said modular member having therein a central hole of a diameter approximately equal to the outer diameter of said projection, said projection portions being deformable inwardly to enable said lowermost modular member to be assembled onto said base member with said projection extending through said central hole, said projection portions deforming outwardly after said lowermost modular member is assembled onto said base member, said flanges thereafter preventing unintentional removal of said lowermost modular member from said base member;

each said modular member having equally circumferentially spaced therearound a plurality of radially outwardly extending arms, each said arm including a bottom wall and two opposite side walls defining a product receiving space, each side wall forming a dihedral angle with the adjacent side wall of the adjacent arm, each pair of side walls defining a dihedral angle being joined at the tops thereof by a triangular element, each said triangular element having a free edge with a notch therein, each said arm having depending downwardly therefrom a tongue element;

said tongue elements of each said modular member being received in said notches of the next lower modular member, each said modular member being circumferentially angularly displaced with respect to the next lower modular member, said notches being positioned and dimensioned such that the receipt therein of the tongue elements of the next upper modular member rigidly fixes together the respective said modular members; and an upper member having depending downwardly therefrom a plurality of tongue elements which fit and are received in the notches of the uppermost of said modular members.

2. A device as claimed in claim 1, wherein the side walls of each said arm of each said modular member extend parallel to each other.

3. A device as claimed in claim 1, wherein each said modular member tongue element depends from the respective said bottom wall at a position midway between the respective said side walls.

4. A device as claimed in claim 1, wherein said upper member includes a plurality of radially extending arms each having depending therefrom a tongue element.

5. A device as claimed in claim 4, wherein each said upper member arm includes a bottom wall and two opposite non-parallel side walls.

* * * * *